US006768261B2

(12) United States Patent
Ha et al.

(10) Patent No.: US 6,768,261 B2
(45) **Date of Patent: *Jul. 27, 2004**

(54) TRANSMISSION TYPE COLOR PLASMA DISPLAY PANEL

(75) Inventors: Hong-Ju Ha, Seoul (KR); Hun-Gun Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 09/888,503

(22) Filed: Jun. 26, 2001

(65) Prior Publication Data

US 2001/0035718 A1 Nov. 1, 2001

Related U.S. Application Data

(63) Continuation of application No. 09/212,577, filed on Dec. 16, 1998, now Pat. No. 6,252,353.

(30) Foreign Application Priority Data

| | | |
|---|---|---|
| Dec. 17, 1997 | (KR) | P97-69770 |
| Dec. 30, 1997 | (KR) | P97-78614 |
| Jan. 12, 1998 | (KR) | P98-611 |
| Feb. 6, 1998 | (KR) | P98-3498 |
| Feb. 12, 1998 | (KR) | P98-4234 |
| Feb. 19, 1998 | (KR) | P98-5130 |

(51) Int. Cl.[7] ..... H01J 17/49

(52) U.S. Cl. ..... 313/582; 313/581; 313/584; 313/585; 313/586; 313/587

(58) Field of Search ..... 313/582, 581, 313/584, 585, 586, 587

(56) References Cited

U.S. PATENT DOCUMENTS

| | | | | |
|---|---|---|---|---|
| 3,811,061 A | * | 5/1974 | Nakayama et al. | 313/518 |
| 4,048,533 A | * | 9/1977 | Hinson et al. | 313/486 |
| 4,320,418 A | * | 3/1982 | Pavliscak | 348/797 |
| 4,803,402 A | * | 2/1989 | Raber et al. | 313/509 |
| 4,853,590 A | | 8/1989 | Andreadakis | |
| 5,182,489 A | * | 1/1993 | Sano | 313/485 |
| 5,656,893 A | * | 8/1997 | Shino et al. | 315/169.4 |
| 5,663,611 A | * | 9/1997 | Seats et al. | 313/584 |
| 5,701,056 A | * | 12/1997 | Shinohara | 313/584 |
| 5,736,815 A | * | 4/1998 | Amemiya | 313/586 |
| 5,742,122 A | * | 4/1998 | Amemiya et al. | 313/582 |
| 5,789,862 A | * | 8/1998 | Makino | 313/584 |
| 5,898,271 A | * | 4/1999 | Mehrotra et al. | 313/582 |
| 5,917,284 A | * | 6/1999 | Moore et al. | 313/586 |
| 5,939,826 A | | 8/1999 | Ohsawa et al. | |
| 5,952,782 A | | 9/1999 | Nanto et al. | |
| 6,072,276 A | * | 6/2000 | Okajima | 313/581 |
| 6,137,550 A | * | 10/2000 | Hinchliffe et al. | 349/32 |
| 6,233,028 B1 | * | 5/2001 | Bruinink et al. | 349/32 |
| 6,252,353 B1 | * | 6/2001 | Ha et al. | 313/582 |

FOREIGN PATENT DOCUMENTS

| | | |
|---|---|---|
| JP | 57-212743 | 12/1982 |
| JP | 02168534 A | 6/1990 |
| JP | HEI3-106654 | 11/1991 |
| JP | 04-075232 | 3/1992 |
| JP | 05-041165 | 2/1993 |
| JP | 05-101782 | 4/1993 |
| JP | 07226164 | 8/1995 |

* cited by examiner

*Primary Examiner*—Nimeshkumar D. Patel
*Assistant Examiner*—Holly Harper
(74) *Attorney, Agent, or Firm*—Fleshner & Kim, LLP

(57) ABSTRACT

A color plasma display panel which includes front and back substrates bonded together to form an integrated body and separated from each other at a predetermined distance, the front substrate being an image displaying surface, the back substrate including a plurality of sustain discharge electrodes forming a pair of plural electrodes in a cell, a dielectric layer for insulating the sustain discharge electrodes, and a protective layer; and the front substrate including a plurality of address electrodes arranged in crossing with the sustain discharge electrodes, and a fluorescent layer for generating visible rays.

18 Claims, 9 Drawing Sheets

TRANSMISSION TYPE COLOR PLASMA DISPLAY PANEL

This is a continuation of application Ser. No. 09/212,577 filed Dec. 16, 1998, now U.S. Pat. No. 6,252,353.

BACKGROUND OF THE INVENTION

1. Field of the Invention

The present invention relates to a plasma display panel (PDP) which is a kind of light-emitting device for displaying an image by using the gas discharge between glass substrates and, more particularly, to a color PDP having an internal structure improved to increase aperture rate of the front panel which is an image displaying surface and maximize the efficiency of light emission using discharge between electrodes.

2. Background of the Related Art

In general, color PDPs are a kind of light-emitting device for displaying an image by use of internal gas discharge. Color PDP's are advantagous in that: (1) PCP's do not require active elements in cells; (2) each cell of the PDP has a simple fabricating process; and (3) PDP's have a high response speed.

In addition, PDPs are more easily enhanced in size relative to existing liquid crystal displays and can be used for large-sized display devices over 40 inches.

The schematic structure of PDPs includes two glass substrates bonded together with a frit glass and sealed to form an integrated body. The sealed internal space between the two glass substrates is filled with a gas under a pressure of 100~600 Torr where the gas may be Xenon (Xe) in Helium (He).

The image display section of a panel has intersections between a plurality of electrodes in correspondence to pixels (cells). When driving the panel to display an image, a voltage greater than 100 volts is applied to the intersections causing glow discharge of gas and emitting lights. This panel section is combined with a driving section to serve as a display device.

PDPs are classified into two-, three- and four-electrode types according to the number of electrodes allotted to each cell: the two-electrode type PDP is driven by applying an addressing and sustaining voltage to two electrodes. The three-electrode type PDP is generally called a "surface discharge type" and is switched or maintained by a voltage applied to an electrode positioned on the lateral side of a discharge cell.

An example of the related art three-electrode surface discharge PDP will be described below in reference with FIGS. 1 to 3.

FIG. 1 is an exploded view of a related art PDP structure having upper and lower substrates. In the figure, a front substrate 1 which is an image displaying surface is combined in parallel with a back substrate 2 at a predetermined distance.

The front substrate 1 is provided with a sustain discharge electrode formed with a pairing of a common electrode C and a scan electrode S. The sustain discharge electrodes are used to sustain light-emission within cells by means of mutual discharges in a pixel.

The front substrate 1 may also be provided with a dielectric layer 5 for restraining a discharge current of the two electrodes and insulating between electrode pairs. Additionally, a protective layer 6 may be formed on the dielectric layer 5.

The back substrate 2 includes a plurality of spaces for discharge with separate walls 3 forming cells, a plurality of address electrodes A formed in the direction parallel with the separate walls 3 for performing address discharge at the intersections with scan electrodes S which creates vacuum ultra-violet rays, and a fluorescent layer 4 formed on the lateral sides of separate walls 3 and on the back substrates out of the internal surface of each discharge space for emitting visible rays to display images during address discharge.

FIG. 2 illustrates the arrangement of common electrodes C, scan electrodes S and address electrodes A.

FIG. 3 is a cross-sectional view of a cell after the upper and lower substrates are bonded together to form an integrated body, in which the lower substrate is rotated at 90 degrees for better understanding.

First, when a discharging voltage is applied between a scan electrode S and a common electrode C that form a pair of electrodes in the cell, surface discharge occurs between the two electrodes to form wall charges on the internal surface of the discharge space.

Following the surface discharge, an address discharge voltage is applied to the scan electrode S, and the address electrode A causes writing discharge to occur in the cell. Subsequently, a sustain discharge voltage is applied to the scan electrode S and the common electrode C. A sustained discharge occurs due to charged particles being generated in the address discharge between address electrode A and scan electrode S. Thus sustaining light-emission of the cell for a predetermined period of time.

In other words, an electric field is formed in a cell due to discharge between electrodes such that a minute quantity of electrons contained in a discharge gas are accelerated and collide with neutral particles in the gas to ionize. Thus, generated electrons collide with another neutral particles to produce more electrons and ions. In turn, the discharge gas is changed into plasma and vacuum ultra-violet rays are generated. The generated ultra-violet rays excite the fluorescent layer 4 to emit visible rays, which are projected to the outside through the front substrate 1 to cause light-emission in a cell.

In the prior art PDP structure as described above, sustain discharge electrodes C and S are fabricated in such a manner that transparent electrodes are patterned in order to prevent reduction of the aperture rate of front substrate 1 on which an image is formed. A metal having a lower resistance than the transparent electrodes is applied to the lateral edge of the transparent electrodes to prevent deterioration of the display quality.

Despite the use of transparent electrodes, there is a loss of about 10 to 25% of visible rays because the sustain discharge electrodes C and S are positioned in the front substrate 1.

The contrast characteristic becomes deteriorated because the light-emitting part is completely exposed to the outside and the reflection factor is high. To enhance the contrast characteristic, use is made of a color filter in spite of deterioration of luminance by about 30 to 50%.

As a measure to enhance the luminance, raising the driving voltage applied to electrodes may increase the amount of generated vacuum ultra-violet rays, which raises production costs in realizing peripheral circuits and causes a rapid reduction of life of the PDP.

SUMMARY OF THE INVENTION

Accordingly, the present invention is directed to a color plasma display panel that substantially obviates one or more of the problems due to limitations and disadvantages of the related art.

An object of the present invention is to enhance the aperture rate of the front substrate by forming a sustain discharge electrode that causes a loss of light in the back substrate.

Another object of the present invention is to provide a fluorescent layer on the front substrate to serve as a color filter and a source of visible rays.

Further another object of the present invention is to enhance discharge efficiency by increasing a discharge path between electrodes.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a plasma display panel including front and back substrates bonded together, the front substrate comprising an image displaying surface, a fluorescent layer and a plurality of address electrodes, and the back substrate including a plurality of sustain discharge electrodes forming a pair of plural electrodes in each cell, a dielectric layer for insulating the sustain discharge electrodes, and a protective layer.

The structure is a reverse application of upper and lower structures of the related art PDP and provides a PDP with enhanced luminance and contrast of emitted beams.

Use of a transparent material is not required to prevent deterioration of the aperture rate due to the sustain discharge electrodes positioned on the back substrate, and the fluorescent layer serving as a source of visible rays as well as a color filter.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF PREFERRED EMBODIMENTS

Figure 1:
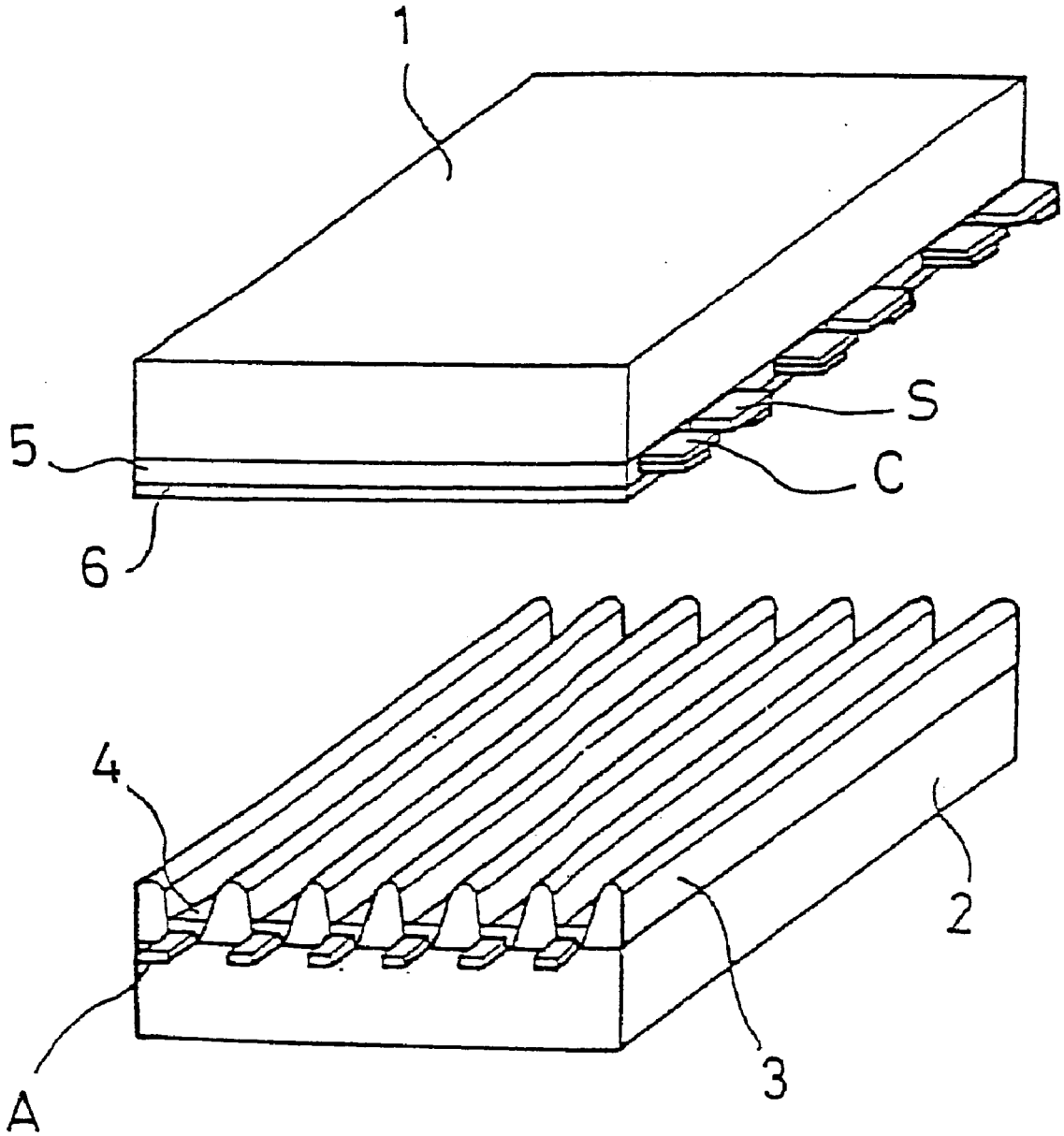
FIG. 1 (PRIOR ART)
FIG. 1 is a diagram that illustrates an exploded perspective of the related art PDP having upper and lower substrates.
Figure 2:
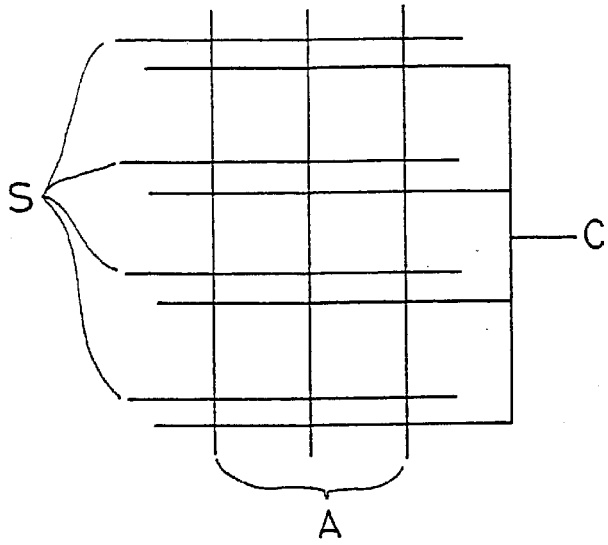
FIG. 2 (PRIOR ART)
FIG. 2 is a diagram that illustrates an arrangement of discharge electrodes of the PDP from the related art.
Figure 3:
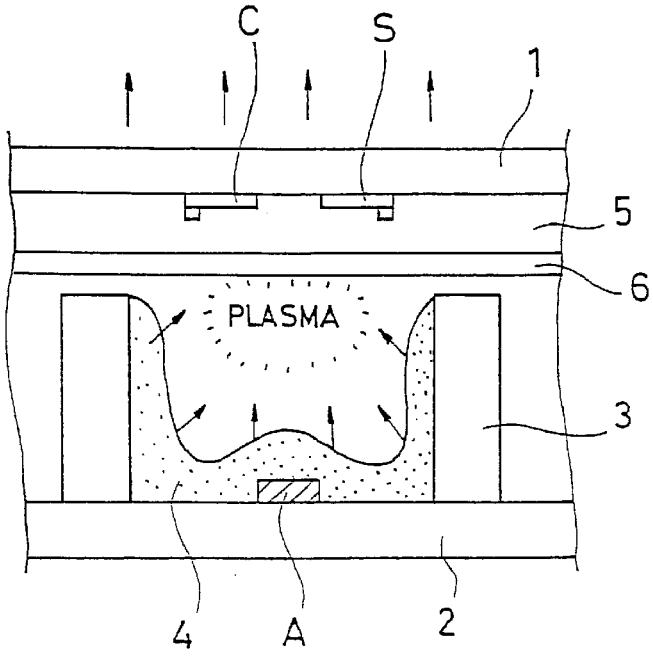
FIG. 3 (PRIOR ART)
FIG. 3 is a diagram that illustrates a cross-sectional view of a discharge cell according to the related art.

Reference will now be made in detail to the preferred embodiments of the present invention, several examples of which are illustrated in the accompanying drawings.

These preferred embodiments will help better understanding of the objects, characteristics and effects of the present invention.

Hereafter, the preferred embodiments of the present invention PDP structure will be described in connection with the attached drawings.

In the figures, the same reference numeral denotes the same component. In the figures, upper and lower substrates are rotated at 90 degrees for better understanding.

Figure 4:
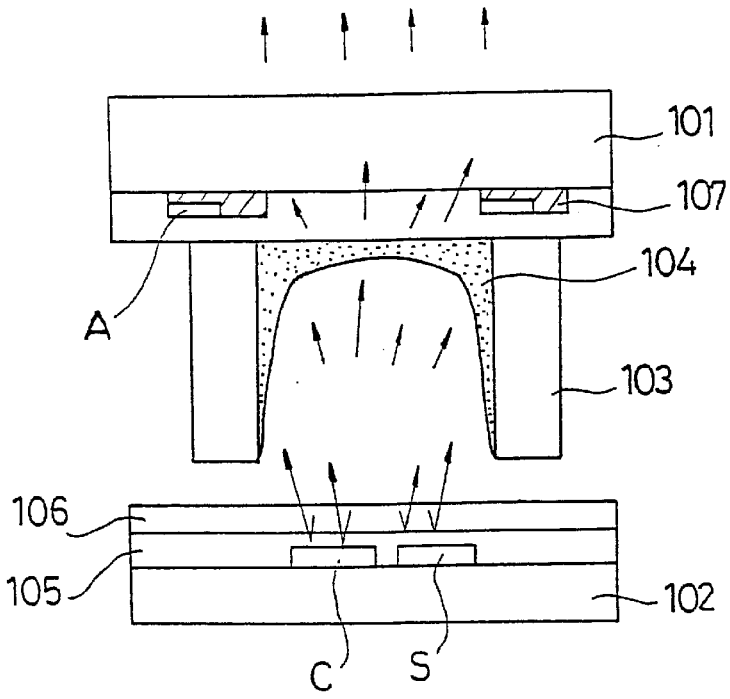
FIG. 4 is a diagram that illustrates a cross-sectional view of a discharge cell according to a first preferred embodiment of the present invention.

As shown in FIG. 4, the PDP structure according to the first preferred embodiment of the present invention includes two substrates spaced from each other at a predetermined distance for discharge space by separate walls 103 to provide a discharge space and bonded together to form an integrated body.

A front substrate 101 is an image displaying surface generates visible rays. The front substrate 101 is provided with a fluorescent layer 104 serving as a color filter for the visible rays to pass through, and a beam masking (BM) layer 107 as well as an address electrode A formed on the top ends of the separate walls 103 to increase the aperture rate.

A back substrate 102 includes a common electrode C and a scan electrode S constituting a sustain discharge electrode in one cell and consisting of a wide metal material, a dielectric layer 105 and a protective layer 106.

The principle discharge between the electrodes in the above transmittance PDP structure is the same as the related art and will be omitted in the following description.

In the first preferred embodiment of the present invention, the address electrode A is positioned as near to the separate walls 103 as possible to minimize a decrease in the aperture rate and the sustain discharge electrodes C and S serve as a reflective layer for reflecting over 90% of visible rays emitted from the fluorescent layer 104.

Increasing the width of sustain discharge electrodes C and S makes it possible to reduce the thickness of electrodes, enhancing yields of fabrication, and decreasing the line resistance which reduces an unbalance of electricity generation that may be caused by a large line resistance.

The beam masking layer 107, as well as address electrodes A are formed along the separated walls 103 to enhance the contrast.

Figure 5:
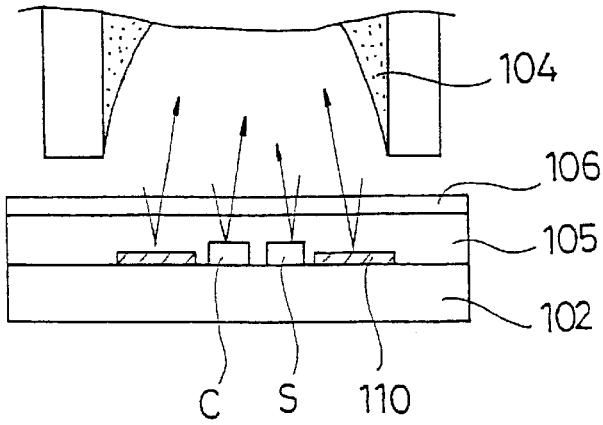
FIGS. 5 and 6 are diagrams that illustrate cross-sectional views of a discharge cell according to a second preferred embodiment of the present invention.

In the second preferred embodiment of the present invention, as shown in FIG. 5, the width of sustain discharge electrodes C and S formed on the back substrate 102 of a transmittance PDP is decreased to prevent mis-discharge between the adjacent cells, while a reflection helper 110 is formed on the outer side of the sustain discharge electrodes C and S (or between pairs of electrodes) to reflect visible rays generated from the fluorescent layer 104.

Figure 6:
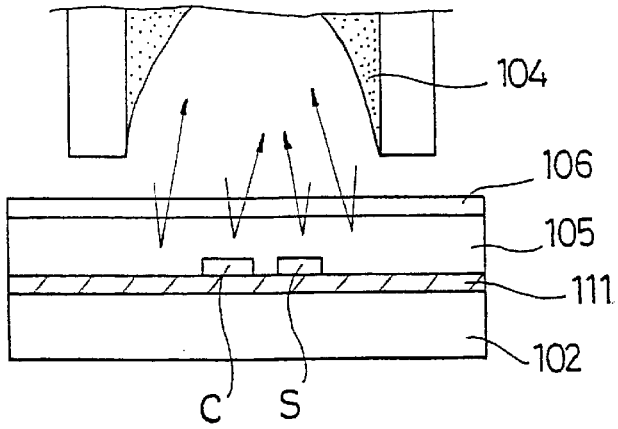

Reflection layer 111 shown in FIG. 6 may also be formed to reflect the visible rays and enhance the luminance and electrical insulation from the sustain discharge electrodes C and S.

Figure 7A:
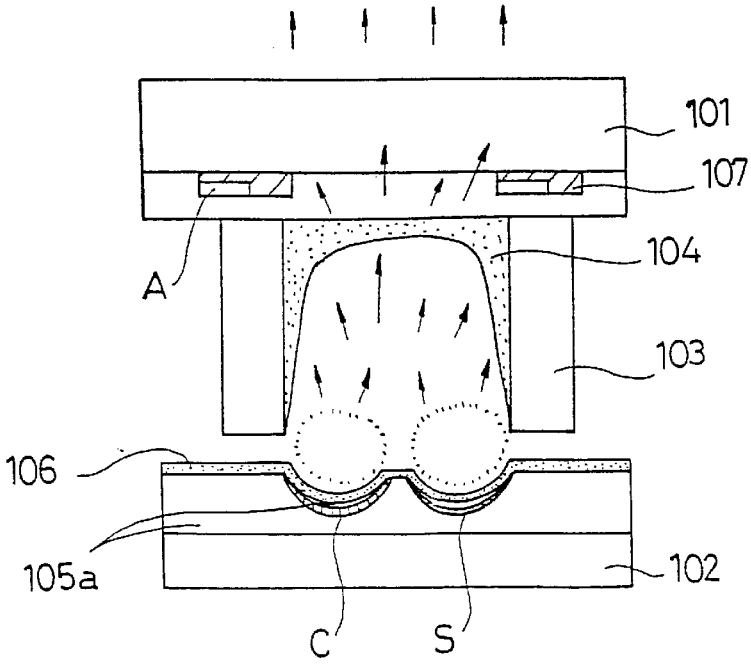
FIG. 7 is a diagram that illustrates a cross-sectional view of a discharge cell according to a third preferred embodiment of the present invention.

In the third preferred embodiment of the present invention, as shown in FIG. 7*a*, a dielectric layer 105*a* is formed on the back substrate 102 and comprises recess portions of which the number of recesses is same as that of the number of sustain discharge electrodes C and S, and a common electrode C and a scan electrode S are formed on the recess portions in the same shape as the recess portions.

Further, another dielectric layer 105*a* is formed on the common electrode C and scan electrode S to surround the sustain discharge electrodes C and S with the dielectric layers.

Such a structure of sustain discharge electrodes C and S can increase a discharge path of an electricity field which plays a great role in forming plasma during discharge for sustaining light emission of cells. An increase in the discharge path raises the number and frequency of electrons exciting the discharge gas which in turn increases the amount of vacuum ultra-violet rays reaching the fluorescent layer 104, thus enhancing discharge efficiency.

A method of forming the structure includes differentially printing or etching the dielectric layer 105*a* on the back substrate 102 to form a semi-oval profile as deep as a predetermined depth in the dielectric layer 105*a* and then forming thin sustain discharge electrodes C and S in the recess portion to obtain recessed sustain discharge electrodes C and S.

Figure 7B:
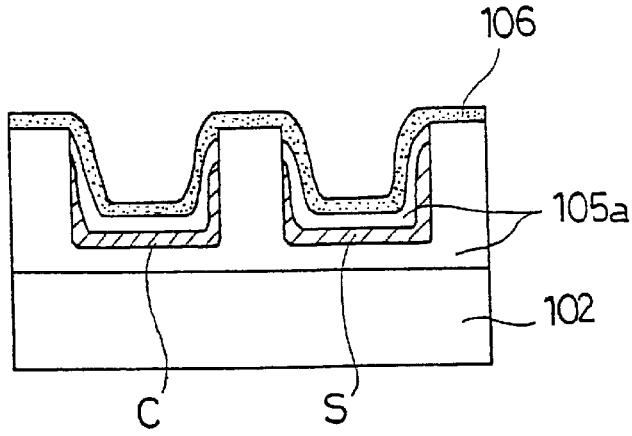

As shown in FIG. 7*b*, the recess profile of the dielectric layer 105*a* can be almost four times as deep to increase the discharge path between the sustain discharge electrodes C and S. The increase in depth can prevent mis-discharge with electrodes of other neighboring cells.

Figure 8A:
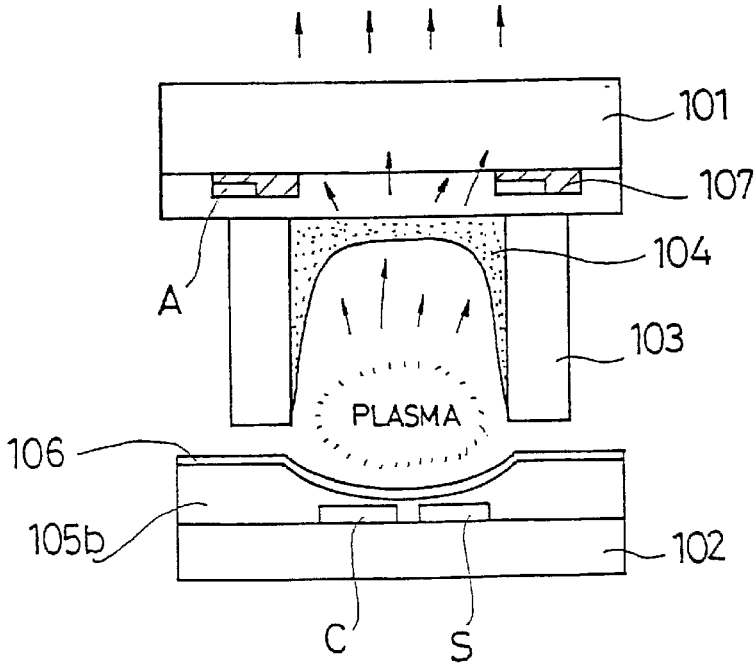
FIG. 8 is a diagram that illustrates a cross-sectional view of a discharge cell according to a fourth preferred embodiment of the present invention.

In the fourth preferred embodiment of the present invention, as shown in FIG. 8*a*, dielectric layer 105*b* is patterned as an optical focusing structure having a curved recess with the thickness gradually decreasing towards the center of each discharge cell making it is possible to provide a discharge space large enough for charged particles to disperse during a discharge between the sustain discharge electrodes C and S.

In other words, since strong discharge plasma and vacuum ultra-violet rays are produced due to a curved recess of the dielectric layer 105*b* as a sustain discharge occurs between scan electrode S and common electrode C, the amount of visible rays emitted from the fluorescent layer 104 and a focusing force of visible rays in the cell are increased thus enhancing the luminance of the emitted light.

Figure 8B:
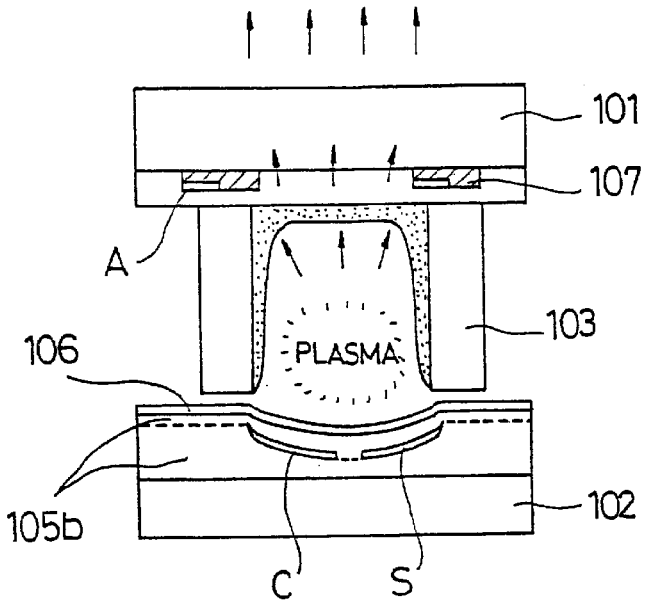

As shown in FIG. 8*b*, a mis-discharge between adjacent cells may be prevented by applying two dielectric layers 105*b* and forming the sustain discharge electrodes C and S between the dielectric layers 105*b* to oppose with each other at a predetermined angle of inclination towards the discharge space.

Figure 9:
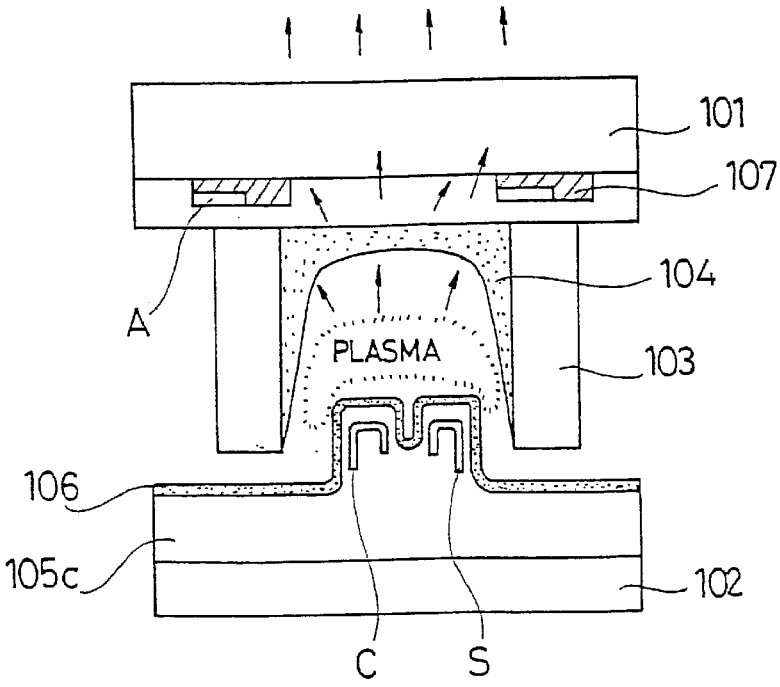
FIG. 9 is a diagram that illustrates a cross-sectional view of a discharge cell according to a fifth preferred embodiment of the present invention.

In the fifth preferred embodiment of the present invention, as shown in FIG. 9, dielectric layer 105*c* is formed to have two projections in each cell such that scan electrode S and common electrode C are positioned in the projections, thereby enhancing discharge efficiency.

When a discharge voltage is applied to the scan electrode S and the common electrode C to sustain the light emission of the cell after lights are emitted from the cell due to an address discharge between the scan electrode S and the address electrode A, a discharge between the sustain discharge electrodes S and C begins between the opposite electrodes, being dispersed all over the area, to increase the discharge path. The sustain discharge electrodes S and C form projections towards the discharge space and easily cause stereo discharge between the electrodes.

Figure 10A:
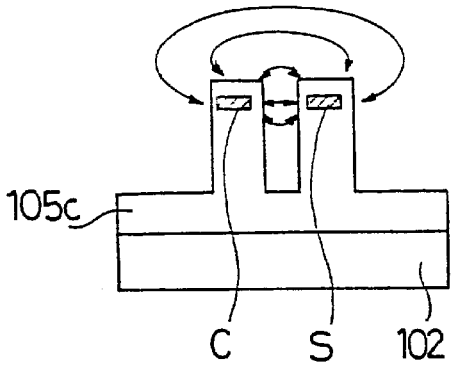
FIG. 10 is a diagram that illustrates a cross-sectional view showing a modification to the discharge cell shown in FIG. 9.
Figure 10B:
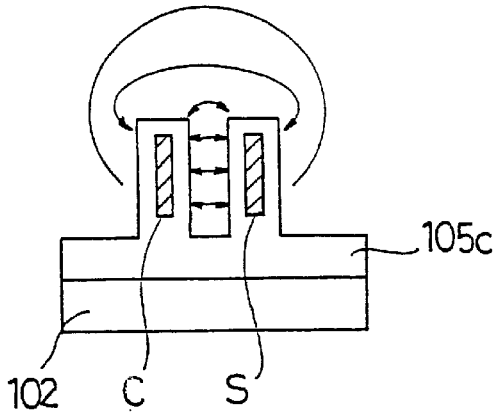

The profiles of the scan electrode S and the common electrode C are not specifically limited to the above embodiments and may be shown in FIGS. 10*a* and 10*b*.

In FIGS. 10*a* and 10*b*, when a discharge voltage is applied to the scan electrode S and the common electrode C, a discharge begins from the nearest part between the electrodes and disperses all over the sustain discharge electrodes S and C, thus increasing the discharge path.

Since the sustain discharge electrodes S and C are exposed to the discharge space, plasma dispersion due to a stereo discharge occurs readily and the distance from the fluorescent layer 104 for transfer of a plasma discharge is reduced, which results in enhancement of discharge efficiency.

Figure 11:
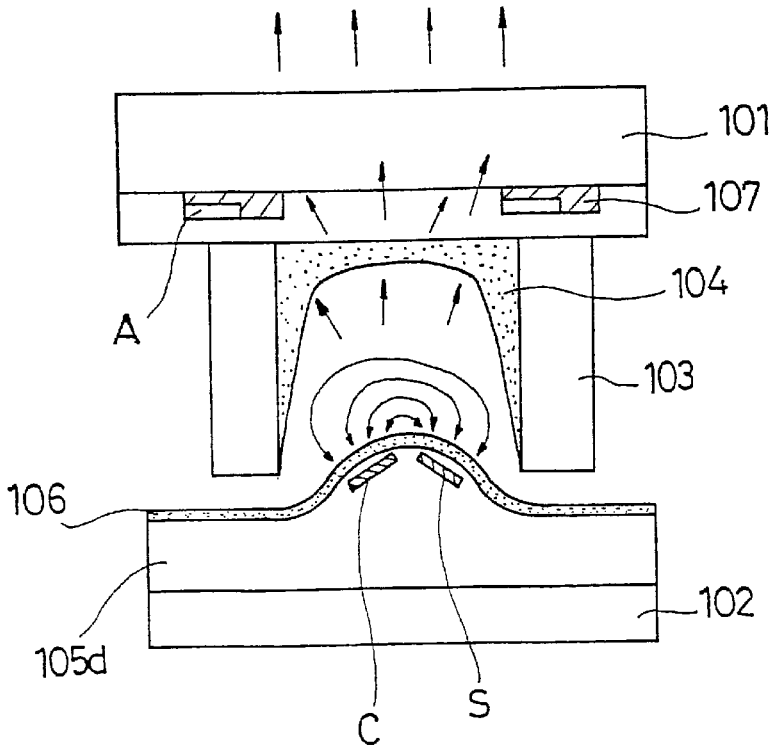
FIG. 11 is a diagram that illustrates a cross-sectional view of a discharge cell according to a sixth preferred embodiment of the present invention.
Figure 12A:
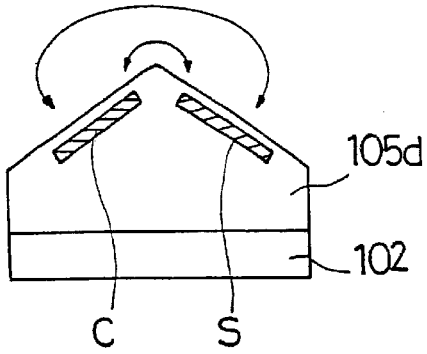
FIG. 12 is a diagram that illustrates a cross-sectional view showing a modification to the discharge cell shown in FIG. 11.
Figure 12B:
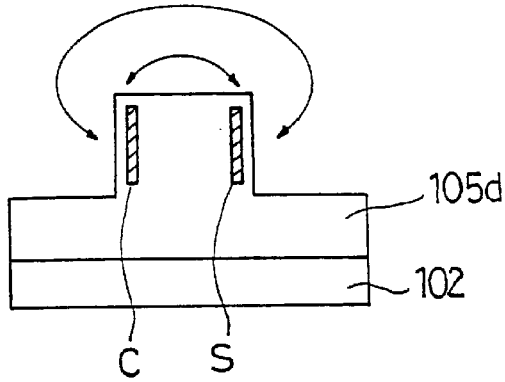
Figure 12C:
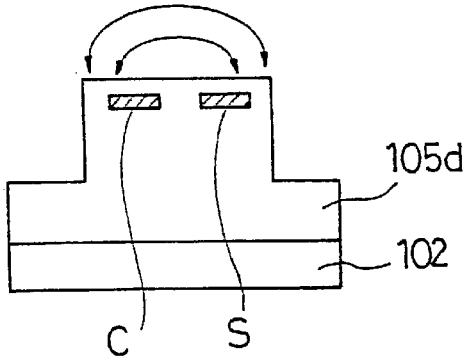
Figure 12D:
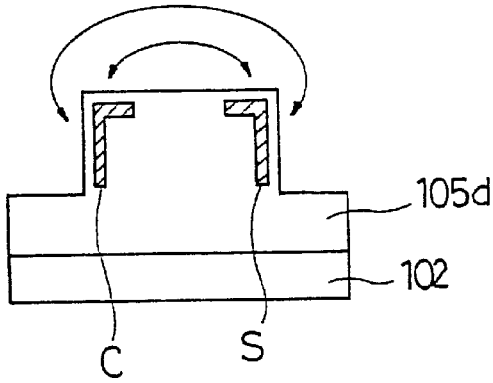
Figure 12E:
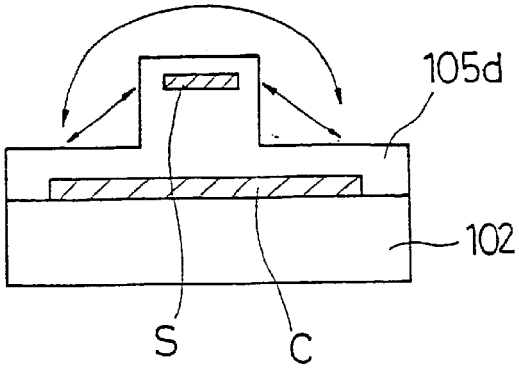

In FIG. 11, the profiles of projections of a dielectric layer 105*d* and sustain discharge electrodes S and C are not specifically limited and may be of various configurations to increase the discharge path, as shown in FIGS. 12*a*–12*e*, since an increased discharge path can enhance discharge efficiency.

Figure 13:
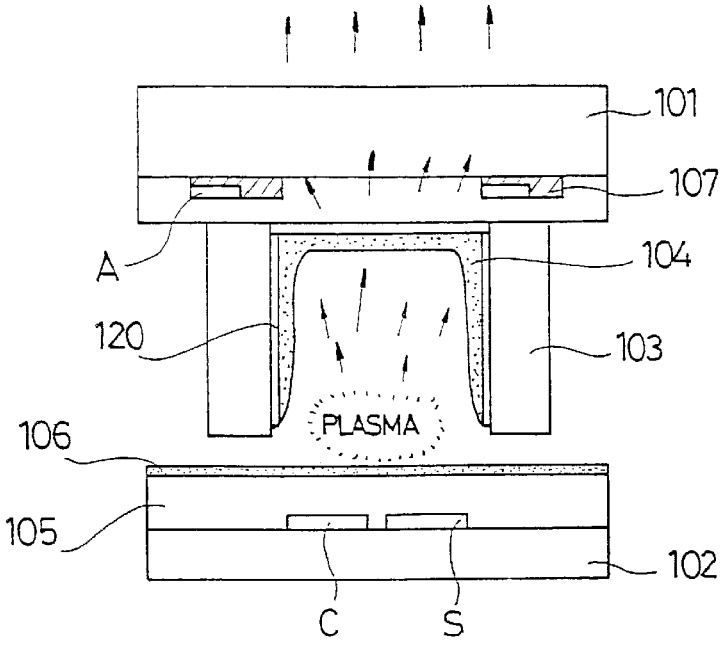
FIGS. 13 and 14 are diagrams that illustrate cross-sectional views of a discharge cell according to a seventh preferred embodiment of the present invention.

In the seventh preferred embodiment of the present invention, as shown in FIG. 13, a transparent electrode 120 is formed along front substrate 101 and separate walls 103, with a fluorescent layer 104 being formed on the transparent electrode 120. The transparent electrode 120 is brought in contact with address electrode A to have conductivity.

The transparent electrode 120 contacts the address electrode A, and is positioned to surround the discharge region. This concentrates a discharge to enhance discharge efficiency due to an address discharge between scan electrode S and address electrode A. The transparent electrode can restrict collisions of generated plasma (especially, cations) with fluorescent layer 104, thus prolonging the life of the fluorescent layer 104.

Due to the transparent electrode 120 having conductivity, ionized fluorescent paste particles may be extracted from the fluorescent layer 104 formed by front deposition towards the conductive transparent electrode 120. It is thus possible to control the thickness of the fluorescent layer 104, which visible rays pass through, by regulating the time.

Figure 14:
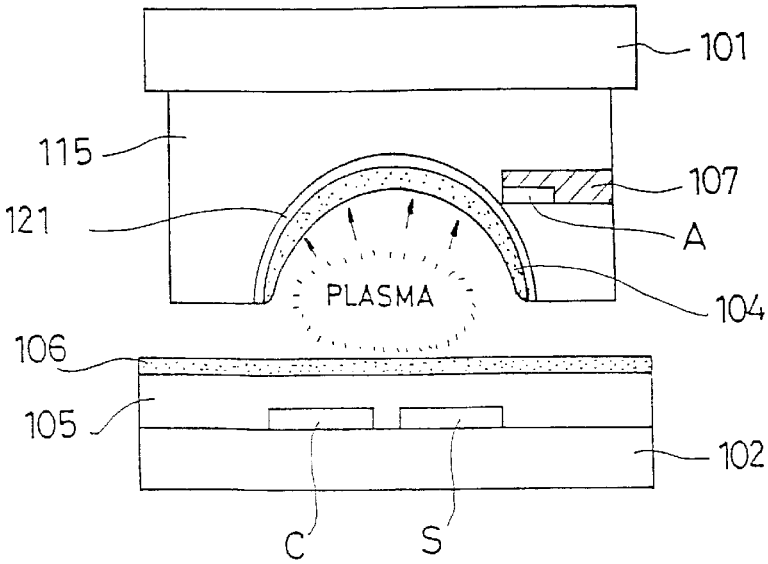

In the structure shown in FIG. 14, in which the thickness of fluorescent layer 104 is also controllable, the upper dielectric layer 115 has a curved recess at each cell formed by etching and a transparent electrode 121 contacting the address electrode A which is formed in the curved recess.

In the present invention as described above by the various preferred embodiments, the PDP's luminance of emitted light can be enhanced by positioning sustain discharge electrodes which cause the deterioration of transmittance of visible rays on the back substrate.

Additionally, the fluorescent layer has a transmittance structure formed on the front substrate to serve as a color filter and a source of visible rays, enhancing the contrast.

Furthermore, the present invention can enhance discharge efficiency between electrodes by increasing a discharge path between sustain discharge electrodes and thereby raising the amount of vacuum ultra-violet rays.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A plasma display panel, comprising:

a back panel which comprises:

a back substrate;

a plurality of cells;

a plurality of pairs of common and scan electrodes with one pair of common and scan electrodes in each cell; and a dielectric layer for insulating the pairs of common and scan electrodes; and a front panel located across from and in a spaced relation from the back panel, wherein the front panel comprises:

a front substrate;

a plurality of address electrodes on the front substrate arranged in crossing with the common and scan electrode pairs;

a fluorescent layer for generating visible rays, wherein a conductive layer is formed between the fluorescent layer of the front substrate and the front substrate; and a dielectric layer on the front substrate between the conductive layer and the front substrate, wherein the dielectric layer has a thickness which decreases gradually towards a center region of a discharge cell.

2. The plasma display panel as claimed in claim 1, wherein the address electrodes are at least partially formed above the separate walls.

3. The plasma display panel as claimed in claim 1, wherein the conductive layer includes a transparent electrode.

4. The plasma display panel as claimed in claim 1, wherein said dielectric layer is an upper dielectric layer with a thickness which decreases gradually towards a center region of each discharge cell.

5. The plasma display panel as claimed in claim 1, wherein the conductive layer is in contact with the address electrodes.

6. A plasma display panel, comprising:

a back panel which comprises:

a back substrate;

a plurality of cells;

a plurality of pairs of common and scan electrodes with one pair of common and scan electrodes in each cell; and a dielectric layer for insulating the pairs of common and scan electrodes; and a front panel located across from and in a spaced relation from the back panel, wherein the front panel comprises:

a front substrate;

a plurality of address electrodes on the front substrate arranged in crossing with the common and scan electrode pairs;

a reflection helper on the back substrate to reflect visible rays, wherein the reflection helper is not in contact with the common and scan electrodes;

a fluorescent layer for generating visible rays; and separate walls that maintain a predetermined distance between the front and back panels and partitioning a discharge spaces, wherein the dielectric layer has a semi-oval profile, wherein the address electrodes are at least partially formed above the separate walls, and wherein the reflection helper is formed apart from the common and scan electrodes in the dielectric layer coplanar to the common and scan electrodes.

7. The plasma display panel as claimed in claim 6, wherein the address electrodes are positioned above a boundary of the discharge space.

8. The plasma display panel as claimed in claim 6, wherein the front substrate further comprises a front dielectric layer, wherein the front dielectric layer is between the plurality of address electrodes and the fluorescent layer.

9. The plasma display panel as claimed in claim 6, wherein the common and scan electrodes comprise a metallic material having high reflection factor for visible rays, and wherein the dielectric layer has at least one curved recess.

10. The plasma display panel as claimed in claim 2, wherein the reflection helper is formed between the common and scan electrodes.

11. The plasma display panel as claimed in claim 6, further comprising a reflective layer for reflection of visible rays is formed between the common and scan electrodes and the back substrate.

12. The plasma display panel as claimed in claim 11, wherein the reflective layer comprises a metallic material electrically insulating from the common and scan electrodes.

13. The plasma display panel as claimed in claim 6, further comprising a transparent electrode between the separate walls and the fluorescent layer and between the front substrate and the fluorescent layer.

14. The plasma display panel as claimed in claim 13, wherein the transparent electrode is in contact with at least one of the address electrodes.

15. A plasma display panel, comprising:

a back panel which comprises:

a back substrate;

a plurality of discharge cells;

a plurality of pairs of common and scan electrodes with one pair of common and scan electrodes in each cell; and a dielectric layer for insulating the pairs of common and scan electrodes; and a front panel located across from and in a spaced relation from the back panel, wherein the front panel comprises:

a front substrate;

a plurality of address electrodes on the front substrate arranged in crossing with the common and scan electrode pairs; and a fluorescent layer for generating visible rays, wherein the dielectric layer is formed to have a curved recess profile with a thickness being gradually decreased towards the center of each discharge cell, wherein the dielectric layer has at least one projection formed as a discharge space in each discharge cell and the at least one of the common and scan electrodes are positioned in the at least one projection of the dielectric layer, wherein each pair of common and scan electrodes have a predetermined inclination less than or greater than zero degrees of inclination and is arranged symmetrically in the projections of the dielectric layer so as to not be parallel with a front surface of the front substrate.

16. The plasma display panel as claimed in claim 15, wherein the common and scan electrodes are formed on the dielectric layer and have a predetermined inclination less than or greater than zero degrees of inclination to form a symmetric profile.

17. The plasma display panel as claimed in claim 15, wherein at least one of the common and scan electrodes not positioned in the projection of the dielectric layer are formed under the projection and are wider than the projection.

18. The plasma display panel as claimed in claim 15, wherein the at least one projection of the dielectric layer is at least two for each discharge cell so that each of the common and scan electrode pairs allotted to each discharge cell are positioned therein.

* * * * *